US009166376B2

(12) United States Patent
Kyuno

(10) Patent No.: US 9,166,376 B2
(45) **Date of Patent: *Oct. 20, 2015**

(54) SPARK PLUG

(71) Applicant: NGK SPARK PLUG CO., LTD., Nagoya (JP)

(72) Inventor: Jiro Kyuno, Kiyosu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 25 days.

This patent is subject to a terminal disclaimer.

(21) Appl. No.: 14/016,845

(22) Filed: Sep. 3, 2013

(65) Prior Publication Data

US 2014/0070691 A1 Mar. 13, 2014

(30) Foreign Application Priority Data

Sep. 11, 2012 (JP) ..... 2012-199317

(51) Int. Cl.
*H01T 13/08* (2006.01)
*H01T 13/12* (2006.01)
*H01T 13/36* (2006.01)

(52) U.S. Cl.
CPC ..... *H01T 13/08* (2013.01); *H01T 13/12* (2013.01); *H01T 13/36* (2013.01)

(58) Field of Classification Search
CPC ..... H01T 13/08; H01T 13/12; H01T 13/36
USPC ..... 315/135
See application file for complete search history.

(56) References Cited

U.S. PATENT DOCUMENTS

| | | | | |
|---|---|---|---|---|
| 6,414,420 | B1 | 7/2002 | Suzuki | |
| 7,400,081 | B2 | 7/2008 | Ishiguro | |
| 2002/0041135 | A1 | 4/2002 | Fukushima et al. | |
| 2005/0017622 | A1 * | 1/2005 | Tamura | 313/143 |
| 2006/0022566 | A1 * | 2/2006 | Ishiguro | 313/143 |

FOREIGN PATENT DOCUMENTS

| | | | |
|---|---|---|---|
| JP | 2000-215964 | A | 8/2000 |
| JP | 2002-83664 | A | 3/2002 |
| JP | 2006-066385 | A | 3/2006 |
| JP | 2007-207770 | A | 8/2007 |

OTHER PUBLICATIONS

Office Action mailed Jul. 29, 2014 for the related Japanese Application No. 2012-199298.

* cited by examiner

*Primary Examiner* — Nimeshkumar Patel
*Assistant Examiner* — Jacob R Stern
(74) *Attorney, Agent, or Firm* — Leason Ellis LLP

(57) ABSTRACT

A spark plug includes a tubular insulator and a tubular metal shell secured to an outer peripheral surface of the insulator by crimping. The tubular metal shell includes: an inner peripheral surface where powder for sealing is filled between the outer peripheral surface and the inner peripheral surface; a tool engagement portion overhanging in a polygonal shape; and a crimped lid disposed at an end portion of the metal shell coupled to the tool engagement portion, the end portion being bent toward the outer peripheral surface of the insulator by crimping. A relationship between a length L and a thickness t satisfies $2.50 \leq L/t \leq 3.10$, the length L being a length along a shape of the crimped lid from the tool engagement portion to the insulator in a planar surface that passes through the axis, the thickness t being a thickness at an intermediate portion of the crimped lid.

5 Claims, 9 Drawing Sheets

SPARK PLUG

This application claims the benefit of Japanese Patent Applications No. 2012-199317 filed with the Japan Patent Office on Sep. 11, 2012, the entire contents of which are hereby incorporated by reference.

FIELD OF THE INVENTION

The present invention relates to a spark plug.

BACKGROUND OF THE INVENTION

A spark plug includes a center electrode assembled to a metal shell via an insulator. In this assembly, for example, an annular ring member is disposed between an outer peripheral surface of the insulator and an inner peripheral surface of the metal shell, and powder for sealing (for example, talc of powder) is filled between the outer peripheral surface and the inner peripheral surface (for example, see JP-A-2000-215964 (Patent Document 1) and JP-A-2006-66385 (Patent Document 2)). Thus, the ring member and the powder disposed between the insulator and the metal shell seal between the insulator and the metal shell. Furthermore, the ring member and the powder improve a force of the metal shell to hold the insulator. Consequently, shock of the insulator by an external force applied to the spark plug (for example, a vibration due to abnormal combustion such as knocking) is suppressed. This allows reduction in damage to the insulator.

SUMMARY OF THE INVENTION

A spark plug includes: a tubular insulator extending along and centered on an axis; a tubular metal shell secured to an outer peripheral surface of the insulator by crimping, the tubular metal shell including an inner peripheral surface and being filled up with powder for sealing between the outer peripheral surface of the insulator and the inner peripheral surface, the metal shell including a tool engagement portion and a crimped lid, the tool engagement portion overhanging in a polygonal shape in an outer circumferential direction, the crimped lid being disposed at an end portion of the metal shell coupled to the tool engagement portion, the end portion being bent toward the outer peripheral surface of the insulator by crimping, the powder being filled between the crimped lid and the insulator; and an annular ring member that contacts the inner peripheral surface of the crimped lid of the metal shell and the outer peripheral surface of the insulator. A relationship between a length L and a thickness t satisfies $2.50 \leq L/t \leq 3.10$, the length L being along a shape of the crimped lid from the tool engagement portion to the insulator in a planar surface that passes through the axis, the thickness t being a thickness at an intermediate portion of the crimped lid.

BRIEF DESCRIPTION OF DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
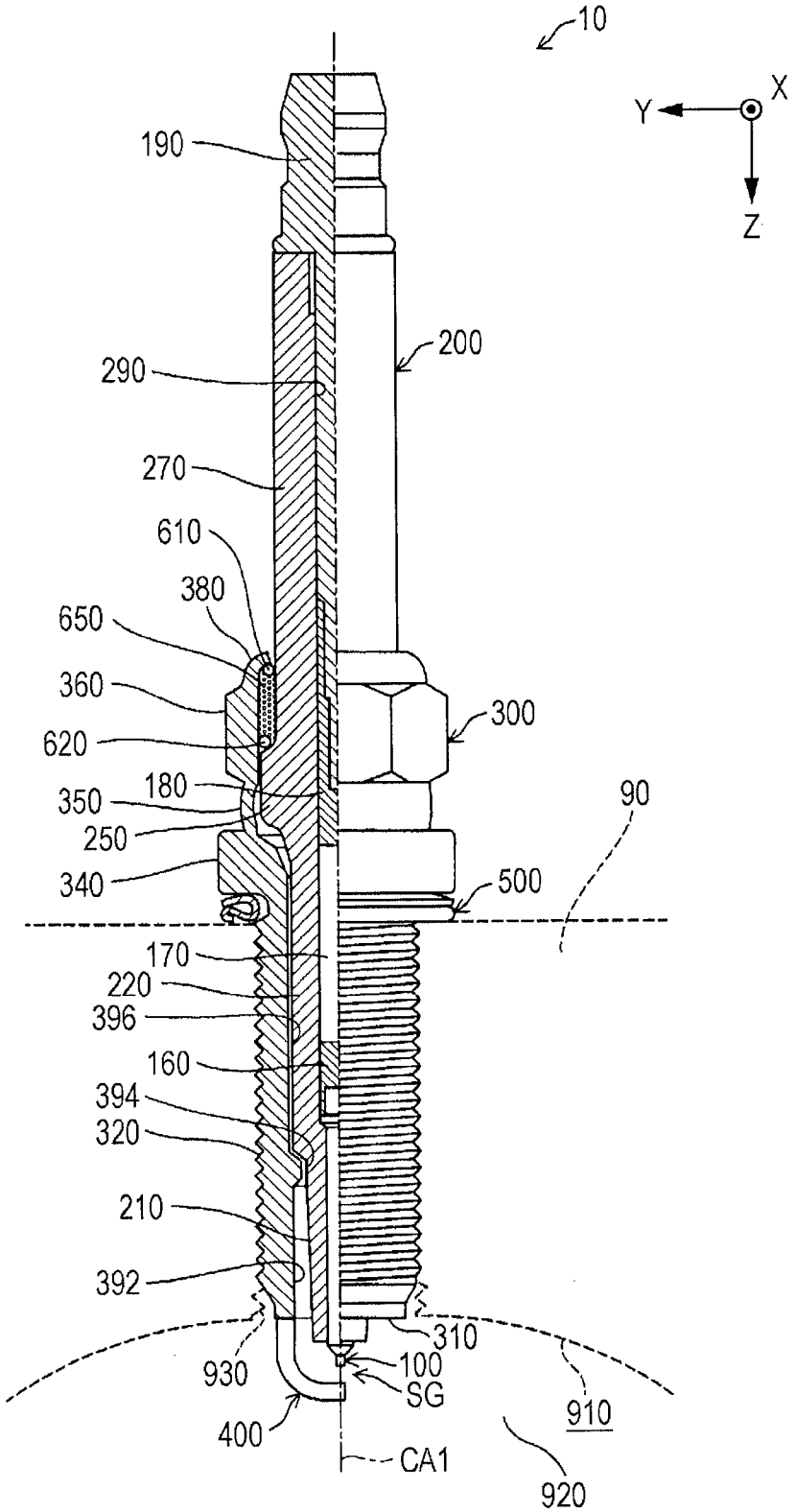
FIG. 1 is an explanatory view illustrating a partial cross-section of a spark plug according to an embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

With a spark plug described in Patent Documents 1 and 2, repeatedly applying an external force to the spark plug may cause powder to spill from between an end portion of a crimped portion and an outer peripheral surface of an insulator. This may degrade a force for a ring member and the powder to hold the insulator. However, in Patent Documents 1 and 2, a close consideration regarding this is not made.

This degradation in the force for the ring member and the powder to hold the insulator may cause damage to the insulator due to shock. Especially, with the spark plug used for an internal combustion engine that tends to be at a comparatively high combustion pressure (for example, a highly supercharged engine and a high compression engine) and a compact spark plug where the insulator needs to be comparatively thin, a holding force of the insulator tends to deteriorate over time. In view of this, the insulator tends to be easily damaged. Accordingly, regarding the spark plug, the spark plug that can reduce damage to the insulator caused by deterioration over time due to an external force is desired.

The spark plug includes an insulator made of, for example, alumina ceramic. The spark plug includes a metal shell made of, for example, carbon steel. Thus, since the insulator and the metal shell are formed of different materials, a difference in thermal expansion occurs between both. If a distance between an outer peripheral surface of the insulator and an inner peripheral surface of the metal shell widens due to the difference in thermal expansion, a force for the ring member and the powder to hold the insulator is degraded. However, in Patent Documents 1 and 2, a close consideration regarding this is not made. Besides, the spark plug is desired to be compact, low cost, resource saving, easy to produce, having better usability, better durability, or the like.

An object of this disclosure is to solve at least a part of the above-described problems. This disclosure can be achieved with the following embodiments.

(1) According to one embodiment of this disclosure, a spark plug is provided. This spark plug includes a tubular insulator, a tubular metal shell, and an annular ring member. The tubular insulator extends along and centered on an axis. The tubular metal shell is secured to an outer peripheral surface of the insulator by crimping. The tubular metal shell includes an inner peripheral surface and is filled up with powder for sealing between the outer peripheral surface of the insulator and the inner peripheral surface. The tubular metal shell includes a tool engagement portion and a crimped lid. The tool engagement portion overhangs in a polygonal shape in an outer circumferential direction. The crimped lid is disposed at an end portion of the metal shell coupled to the tool engagement portion. The end portion is bent toward the outer peripheral surface of the insulator by crimping. The powder is filled between the crimped lid and the insulator. The annular ring member contacts the inner peripheral surface of the crimped lid of the metal shell and the outer peripheral surface of the insulator. A relationship between a length L and a thickness t satisfies $2.50 \leq L/t \leq 3.10$. The length L is a length along a shape of the crimped lid from the tool engagement portion to the insulator in a planar surface that passes through the axis. The thickness t is a thickness at an intermediate portion of the crimped lid. With the spark plug according to this embodiment, a pressing force to the ring member by the crimped lid against the powder can be improved. This allows improving a force for the powder to hold the insulator. Consequently, damage to the insulator caused by deterioration over time due to an external force can be reduced.

(2) With the spark plug according to the above-described embodiment, a relationship between a minimum outer diameter d of the insulator and a maximum inner diameter D of the metal shell in a filling-up area may satisfy $1.12 \leq D/d \leq 1.16$. The minimum outer diameter d and maximum inner diameter D are in the filling-up area where the powder is filled between the metal shell and the insulator. With the spark plug according to this embodiment, a difference in thermal expansion between the insulator and the metal shell can be reduced. This can further suppress reduction in a force of the powder to hold the insulator.

(3) With the spark plug according to the above-described embodiment, the metal shell may include a threaded portion with a nominal diameter of equal to or less than M12. With the spark plug according to the embodiment, in the spark plug with the nominal diameter of equal to or less than M12, damage to the insulator caused by deterioration over time due to an external force can be reduced.

This disclosure can be achieved by various embodiments other than the spark plug. For example, this disclosure can be achieved by the insulator of the spark plug, the metal shell of the spark plug, an internal combustion engine that includes the spark plug, a method for manufacturing the spark plug, an ignition method using the spark plug, a computer program for executing the ignition method, or a non-temporary storage medium that records the computer program.

A. Embodiment:

A-1. Constitution of Spark Plug:

FIG. 1 is an explanatory view illustrating a partial cross-section of a spark plug 10 according to an embodiment. In FIG. 1, an appearance shape of the spark plug 10 is illustrated at the right side on the paper with an axis CA1, which is an axis center of the spark plug 10, set as a border. On the other hand, a cross-sectional shape of the spark plug 10 is illustrated at the left side on the paper. In the explanation of this embodiment, the lower side on the paper of FIG. 1 in the spark plug 10 is referred to as a "front end side" while the upper side on the paper of FIG. 1 is referred to as a "rear end side".

The spark plug 10 includes a center electrode 100, an insulator 200, a metal shell 300, and a ground electrode 400. In this embodiment, the axis CA1 of the spark plug 10 is also an axis center of the center electrode 100, the insulator 200, and the metal shell 300.

The spark plug 10 includes a gap SG formed between the center electrode 100 and the ground electrode 400 at the front end side. The gap SG of the spark plug 10 is also referred to as a spark gap. The spark plug 10 can be installed in an internal combustion engine 90 with the front end side where the gap SG is formed being projected from an inner wall 910 of a combustion chamber 920. Applying a high voltage of 20000 to 30000 volts to the center electrode 100 with the spark plug 10 being installed to the internal combustion engine 90, a spark discharge occurs at the gap SG. The spark discharge occurring at the gap SG allows ignition of the air-fuel mixture in the combustion chamber 920.

In FIG. 1, an X-axis, a Y-axis, and a Z-axis (hereinafter collectively referred to as XYZ axes) perpendicular to one another are illustrated. The XYZ axes in FIG. 1 correspond to XYZ axes in other drawings described below.

In the XYZ axes of FIG. 1, an axis along the axis CA1 is referred to as a Z-axis. Regarding a Z-axial direction along the Z-axis (an axial direction), a direction from the rear end side to the front end side of the spark plug 10 is referred to as +Z-axial direction and the opposite direction is referred to as −Z-axial direction. The +Z-axial direction is a direction that the center electrode 100 goes along the axis CA1 and projects from the front end side of the metal shell 300 together with the insulator 200.

In XYZ-axes of FIG. 1, an axis along a direction that the ground electrode 400 bends to the axis CA1 is referred to as Y-axis. Regarding the direction along the Y-axis (Y-axial direction), a direction that the ground electrode 400 bends to the axis CA1 is referred to as −Y-axial direction and the opposite direction is referred to as +Y-axial direction.

In the XYZ-axes of FIG. 1, an axis perpendicular to the Y-axis and the Z-axis is referred to as X-axis. Regarding X-axial direction along the X-axis, a direction from the back of the paper to the front of the paper of FIG. 1 is referred to as +X-axial direction and the opposite direction is referred to as −X-axial direction.

The center electrode 100 of the spark plug 10 is a conductive electrode body. The center electrode 100 has a rod shape centered on the axis CA1 and extending along the axis CA1. In this embodiment, the material of the center electrode 100 is nickel alloy (for example, inconel (registered trademark)) that includes nickel (Ni) as a main constituent. The outer surface of the center electrode 100 is electrically insulated from the outside by the insulator 200.

The center electrode 100 includes a front end side projected from the front end side of the insulator 200. The center electrode 100 includes a rear end side electrically coupled to the rear end side of the insulator 200. In this embodiment, the rear end side of the center electrode 100 electrically couples to the rear end side of the insulator 200 via a seal body 160, a ceramic resistor 170, a seal body 180, and a metal terminal nut 190.

The ground electrode 400 of the spark plug 10 is a conductive electrode body. The ground electrode 400 extends from the metal shell 300 in parallel with the axis CA1 and then bends toward the axis CA1. The ground electrode 400 includes a base end portion sealed to the metal shell 300. The ground electrode 400 includes a front end portion that forms the gap SG with the center electrode 100. In this embodiment, the material of the ground electrode 400 is nickel alloy (for example, inconel (registered trademark)) that includes nickel (Ni) as a main constituent.

The spark plug 10 includes the insulator 200, which is an insulator having an electrical insulation property. The insulator 200 has a coefficient of thermal expansion smaller than a coefficient of thermal expansion of the metal shell 300. The insulator 200 has a tubular shape centered on the axis CA1 and extending along the axis CA1. In this embodiment, the insulator 200 is formed by baking an insulating ceramics material such as alumina.

The insulator 200 includes an axial hole 290. The axial hole 290 is a through hole centered on the axis CA1 and extending along the axis CA1. In the axial hole 290 of the insulator 200, the center electrode 100 is held on the axis CA1. The center electrode 100 includes a first tubular portion 210, a second tubular portion 220, a third tubular portion 250, and a fourth tubular portion 270 outside of the insulator 200, which projects from the front end side of the insulator 200 (a +Z-axial direction side), in the order from the front end side to the rear end side.

The first tubular portion 210 of the insulator 200 has a tubular shape tapered off toward the front end side. The front end side of the first tubular portion 210 projects from the front end side of the metal shell 300. The second tubular portion 220 of the insulator 200 has a tubular shape with an outer diameter larger than an outer diameter of the first tubular portion 210. The third tubular portion 250 of the insulator 200 has a tubular shape that overhangs toward an outer circumferential direction and has an outer diameter larger than an outer diameter of the second tubular portion 220 and an outer diameter of the fourth tubular portion 270. The fourth tubular portion 270 of the insulator 200 has a tubular shape and is disposed at the rear end side from the third tubular portion 250. The rear end side of the fourth tubular portion 270 projects from the rear end side of the metal shell 300.

The metal shell 300 of the spark plug 10 has a conductive metal body. The metal shell 300 has a coefficient of thermal expansion greater than a coefficient of thermal expansion of the insulator 200. The metal shell 300 has a tubular shape centered on the axis CA1 and extending along the axis CA1. In this embodiment, the metal shell 300 is a low-carbon steel metal body formed into a tubular form and nickel plated. In another embodiment, the metal shell 300 may be a galvanized metal body. Or, the metal shell 300 may be a metal body where plating is not performed (non-plating).

The insulator 200 is held at the inside of the metal shell 300 projecting from the front end side of the metal shell 300 (the +Z-axial direction side) together with the center electrode 100. The metal shell 300 includes a metal shell inner peripheral surface 392, an annular-shaped convex portion 394, and a metal shell inner peripheral surface 396 inside (the inner peripheral surface) in the order from the front end side to the rear end side.

The metal shell inner peripheral surface 392 of the metal shell 300 is disposed at the inner peripheral surface of the metal shell 300 at the front end side from the annular-shaped convex portion 394. The annular-shaped convex portion 394 of the metal shell 300 is disposed between the metal shell inner peripheral surface 392 and the metal shell inner peripheral surface 396, which are the inner peripheral surface of the metal shell 300. The annular-shaped convex portion 394 has an internally bulged annular shape. The metal shell inner peripheral surface 396 of the metal shell 300 is disposed at the inner peripheral surface of the metal shell 300 at the rear end side from the annular-shaped convex portion 394.

A clearance between the metal shell inner peripheral surface 392 and the insulator 200 is larger than a clearance between the annular-shaped convex portion 394 and the insulator 200, and a clearance between the metal shell inner peripheral surface 396 and the insulator 200. The insulator 200 is inserted from the rear end side of the metal shell 300 and is assembled to the metal shell 300. At this time, the annular-shaped convex portion 394 and the metal shell inner peripheral surface 396 are used for positioning the insulator 200 relative to the metal shell 300.

The metal shell 300 is crimped and secured to the outer surface of the insulator 200 electrically insulated from the center electrode 100. The metal shell 300 includes a front end portion 310, a threaded portion 320, a trunk portion 340, a groove portion 350, a tool engagement portion 360, and a crimped lid 380 outside in the order from the front end side to the rear end side.

The metal shell 300 includes a tubular front end portion 310 at the front end side (the +Z-axial direction side). The front end portion 310 is sealed to the ground electrode 400. The insulator 200 projects from the center of the front end portion 310 in the +Z-axial direction together with the center electrode 100.

The threaded portion 320 of the metal shell 300 has a tubular shape with an outer peripheral surface where a thread is formed. In this embodiment, the threaded portion 320 of the metal shell 300 is threaded into a threaded hole 930 of the internal combustion engine 90. This allows installing the spark plug 10 to the internal combustion engine 90. In this embodiment, the threaded portion 320 has a nominal diameter of M10. In another embodiment, the nominal diameter of the threaded portion 320 may be smaller than M10. The nominal diameter of the threaded portion 320 may be, for example, M8 or M9. Further, in another embodiment, the nominal diameter of the threaded portion 320 may be larger than M10. The nominal diameter of the threaded portion 320 may be, for example, M12 or M14.

The trunk portion 340 of the metal shell 300 has a flange shape that overhangs toward an outer circumferential direction more than the groove portion 350. With the spark plug 10 installed to the internal combustion engine 90, a gasket 500 is compressed between the trunk portion 340 and the internal combustion engine 90.

The tubular groove portion 350 of the metal shell 300 is disposed between the trunk portion 340 and the tool engagement portion 360. The groove portion 350 has a tubular shape. When the metal shell 300 is crimped and secured to the insulator 200, the groove portion 350 is bulged in the outer circumferential direction.

The tool engagement portion 360 of the metal shell 300 has a flange shape and overhangs in a polygonal shape toward the outer circumferential direction more than the groove portion 350. The tool engagement portion 360 has a shape (an outline) so as to engage a tool (not shown) for installing the spark plug 10 to the internal combustion engine 90. In this embodiment, the outline of the tool engagement portion 360 is a hexagon.

The crimped lid 380 of the metal shell 300 is formed by bending the rear end side of the metal shell 300 toward the insulator 200 when the metal shell 300 is crimped and secured to the insulator 200.

A ring member 610 and a ring member 620 are disposed between the outside of the third tubular portion 250 and the fourth tubular portion 270 of the insulator 200 and inside of the tool engagement portion 360 and the crimped lid 380 of the metal shell 300. The ring member 610 is disposed at the rear end side while the ring member 620 is disposed at the front end side. Powder 650 is filled between the ring member 610 and the ring member 620. The ring members 610 and 620 are annular shape members made of metal (for example, steel (Fe)). The powder 650 is powder for sealing (for example, talc of powder). The ring member 610, the ring member 620, and the powder 650 seal between the insulator 200 and the metal shell 300. Accordingly, the ring member 610, the ring member 620, and the powder 650 improve a force for the metal shell 300 to hold the insulator 200.

Figure 2:
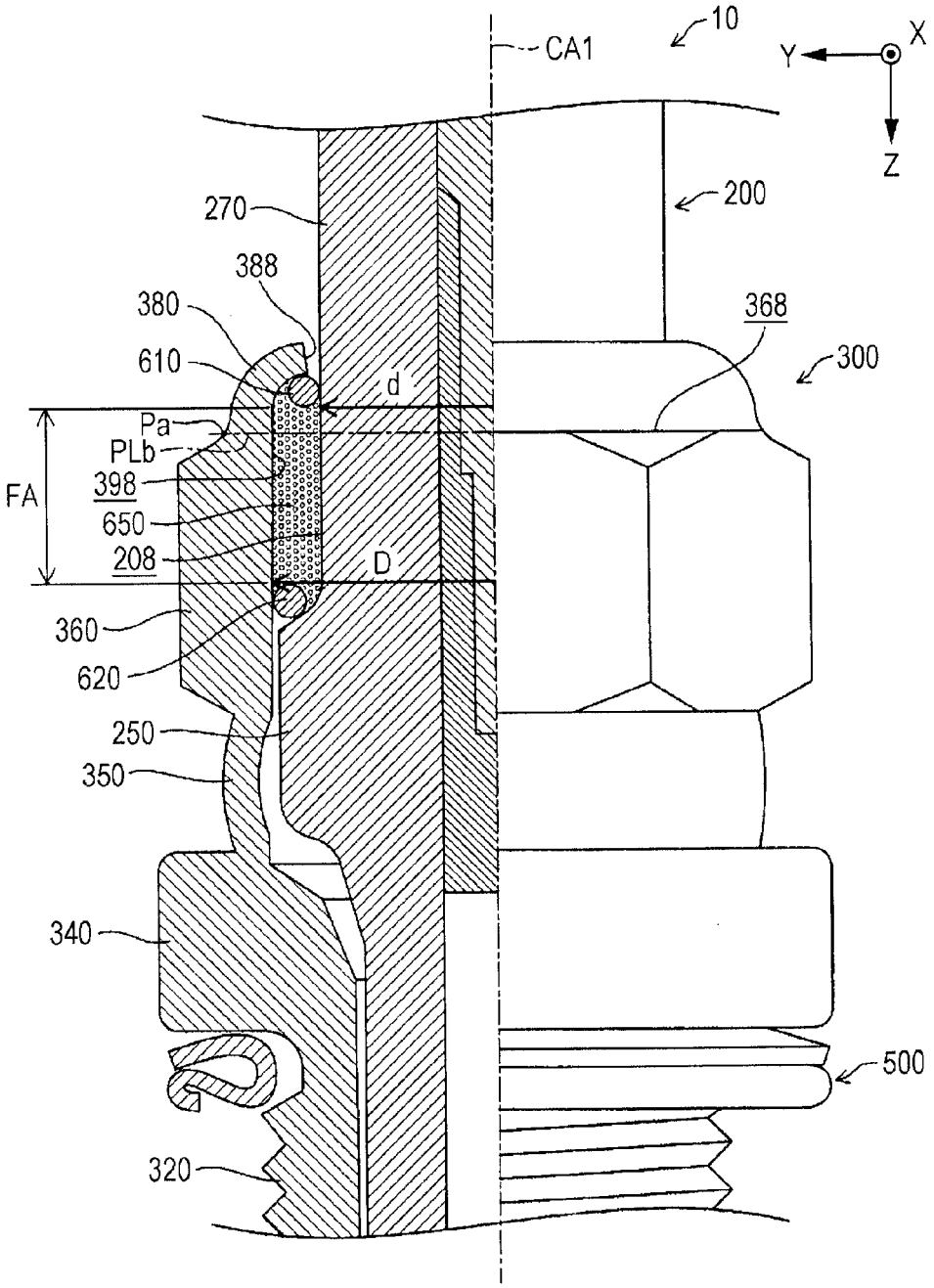
FIG. 2 is an explanatory view illustrating the partial cross-section of the spark plug in an enlarged manner.

FIG. 2 is an explanatory view illustrating a partial cross-section of the spark plug 10 in an enlarged manner. In FIG. 2, a partial cross-section around the tool engagement portion 360 in the spark plug 10 is illustrated more enlarged than that of FIG. 1.

As illustrated in FIG. 2, the crimped lid 380 of the metal shell 300 is formed by bending an end portion 388 of the metal shell 300 coupled to the tool engagement portion 360 toward an outer peripheral surface 208 of the insulator 200 by crimping. The crimped lid 380 seals the ring member 610, the ring member 620, and the powder 650. The powder 650 for sealing is filled between the outer peripheral surface 208 from the third tubular portion 250 to the fourth tubular portion 270 of the insulator 200 and an inner peripheral surface 398 from the tool engagement portion 360 to the crimped lid 380 of the metal shell 300.

The ring member 610 is pressed to the outer peripheral surface 208 of the insulator 200 by the crimped lid 380 of the metal shell 300. The ring member 610 contacts the outer peripheral surface 208 in the fourth tubular portion 270 of the insulator 200 and the inner peripheral surface 398 in the crimped lid 380 of the metal shell 300. The ring member 620 is disposed at the front end side from the ring member 610. The ring member 620 contacts the outer peripheral surface 208 in the third tubular portion 250 of the insulator 200 and the inner peripheral surface 398 in the tool engagement portion 360 of the metal shell 300.

Excluding regions where the ring member 610 and the ring member 620 are disposed, an area between the insulator 200 and the metal shell 300 where the powder 650 is filled along the axis CA1 is referred to as a filling-up area FA. In the filling-up area FA, the smallest outer diameter in the outer diameter of the insulator 200 is referred to as a minimum outer diameter d. In the filling-up area FA, the largest inner diameter in the inner diameter of the metal shell 300 is referred to as a maximum inner diameter D.

In view of reducing damage to the insulator 200 caused by a difference in thermal expansion between the insulator 200 and the metal shell 300, it is preferred that the relationship between the minimum outer diameter d of the insulator 200 in the filling-up area FA and the maximum inner diameter D of the metal shell 300 in the filling-up area FA satisfy $1.12 \leq D/d \leq 1.16$. An evaluation result of a value (D/d) will be described below.

In an example illustrated in FIG. 2, the maximum inner diameter D of the metal shell 300 is located at the end of +Z-axial direction side in the filling-up area FA. However, the maximum inner diameter D is not limited to that location. The maximum inner diameter D may be located at the intermediate portion of the filling-up area FA and may be located at the end of the filling-up area FA at the −Z-axial direction side.

In an example illustrated in FIG. 2, the minimum outer diameter d of the insulator 200 is located at the end of −Z-axial direction side in the filling-up area FA. However, the minimum outer diameter d is not limited to that location. The minimum outer diameter d may be located at the intermediate portion of the filling-up area FA and may be at the end of +Z-axial direction side in the filling-up area FA.

As illustrated in FIG. 2, the tool engagement portion 360 includes an end face 368 at the end portion of the rear end side. A planar surface that passes through the end face 368 and is parallel to the X-axis and the Y-axis is referred to as a planar surface PLb. A point where the planar surface PLb and the outer surface of the metal shell 300 intersect is referred to as a point Pa. The crimped lid 380 is formed at the −Z-axial direction side with respect to the point Pa.

Figure 3:
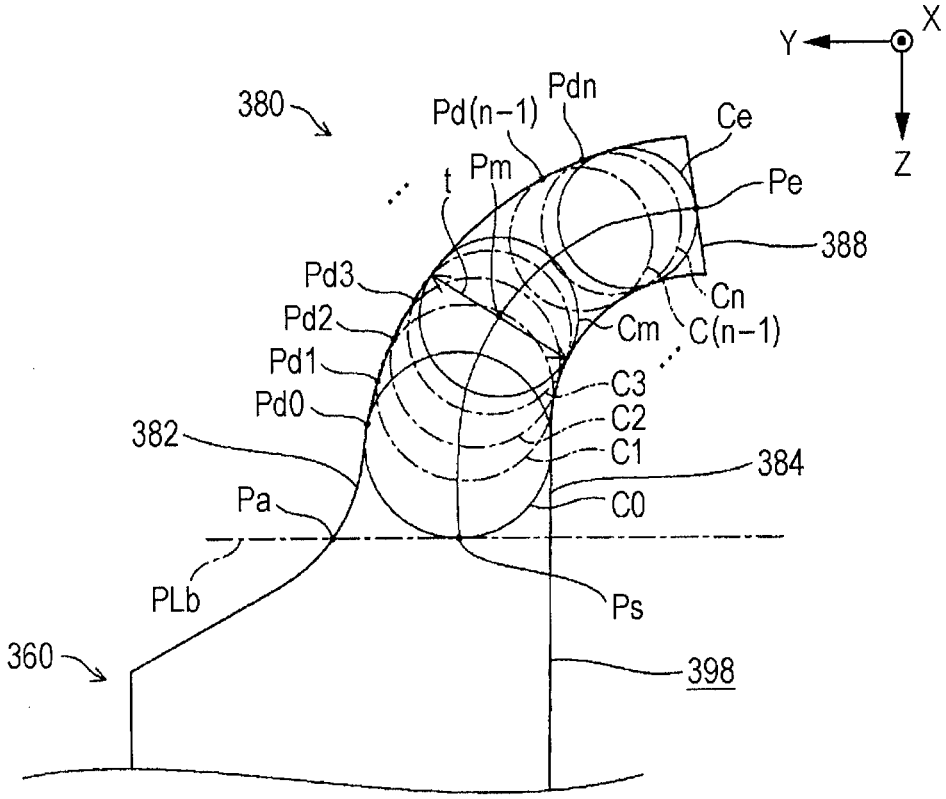
FIG. 3 is an explanatory view illustrating a partial cross-section of a crimped lid in an enlarged manner.

FIG. 3 is an explanatory view illustrating a partial cross-section of the crimped lid 380 in an enlarged manner. The partial cross-section illustrated in FIG. 3 is a cross-section of the crimped lid 380 cut off on the Y-Z plane, which passes through the axis CA1 and is parallel to the Y-axis and the Z-axis. In FIG. 3, the cross-section of the crimped lid 380 is more enlarged than that of FIG. 2.

In the Y-Z plane, a virtual circle contacting an outline 382 outside of the crimped lid 380, an outline 384 inside of the crimped lid 380, and the planar surface PLb is referred to as a circle C0. A contact point of the circle C0 and the planar surface PLb is referred to as a point Ps.

In the Y-Z plane, a virtual circle contacting the outline 382, the outline 384, and the end portion 388 of the crimped lid 380 is referred to as a circle Ce. A contact point of a circle Ce and the end portion 388 is referred to as a point Pe.

In the Y-Z plane, a contact point of the circle C0 and the outline 382 is referred to as a point Pd0. A point starting from the point Pd0 advancing 0.20 mm (millimeter) in the outline 382 toward the end portion 388 is referred to as to a point Pd1. In the virtual circle that passes through the point Pd1 and contacts the outline 384, the virtual circle with the minimum diameter is referred to as a circle C1. A point starting from the point Pd1 advancing 0.20 mm in the outline 382 toward the end portion 388 is referred to as to a point Pd2. In the virtual circle that passes through the point Pd2 and contacts the outline 384, the virtual circle with the minimum diameter is referred to as a circle C2. Thus, a point starting from a point Pd (k−1) advancing 0.20 mm in the outline 382 toward the end portion 388 within a range not exceeding the contact point of the circle Ce and the outline 382 is referred to as a point Pdk. In the virtual circle that passes through the point Pdk and contacts the outline 384, the virtual circle with the minimum diameter is referred to as a circle Ck (k=2, 3, 4, 5 . . . (n−1), n, (n: natural number)).

In the Y-Z plane, a curved line that passes through the point Ps as the starting point, the center of the circle C1, the center of the circle C2, . . . , the center of the circle C (n−1), the center of the circle Cn, and then reaches to a point Pe is referred to as a curved line Ps-Pe. A length of the curved line Ps-Pe is referred to as a length L. The length L is a length along a shape of the crimped lid 380 from the tool engagement portion 360 to the insulator 200 in the planar surface passing through the axis CA1.

In the Y-Z plane, a point advancing by a length (L/2) starting from the point Ps on the curved line Ps-Pe is referred to as a point Pm. The point Pm is the intermediate portion of the crimped lid 380. Centering this point Pm, in the virtual circle internally contacting the outline 382 and the outline 384, the virtual circle with the minimum diameter is referred to as a circle Cm. The diameter of the circle Cm is assumed as a thickness t at the intermediate portion of the crimped lid 380.

In view of reducing damage to the insulator 200 caused by a difference in thermal expansion between the insulator 200 and the metal shell 300, it is preferred that the relationship between the length L of the crimped lid 380 and the thickness t of the crimped lid 380 satisfy $2.50 \leq L/t \leq 3.10$. An evaluation result of the value (L/t) will be described below.

Figure 8:
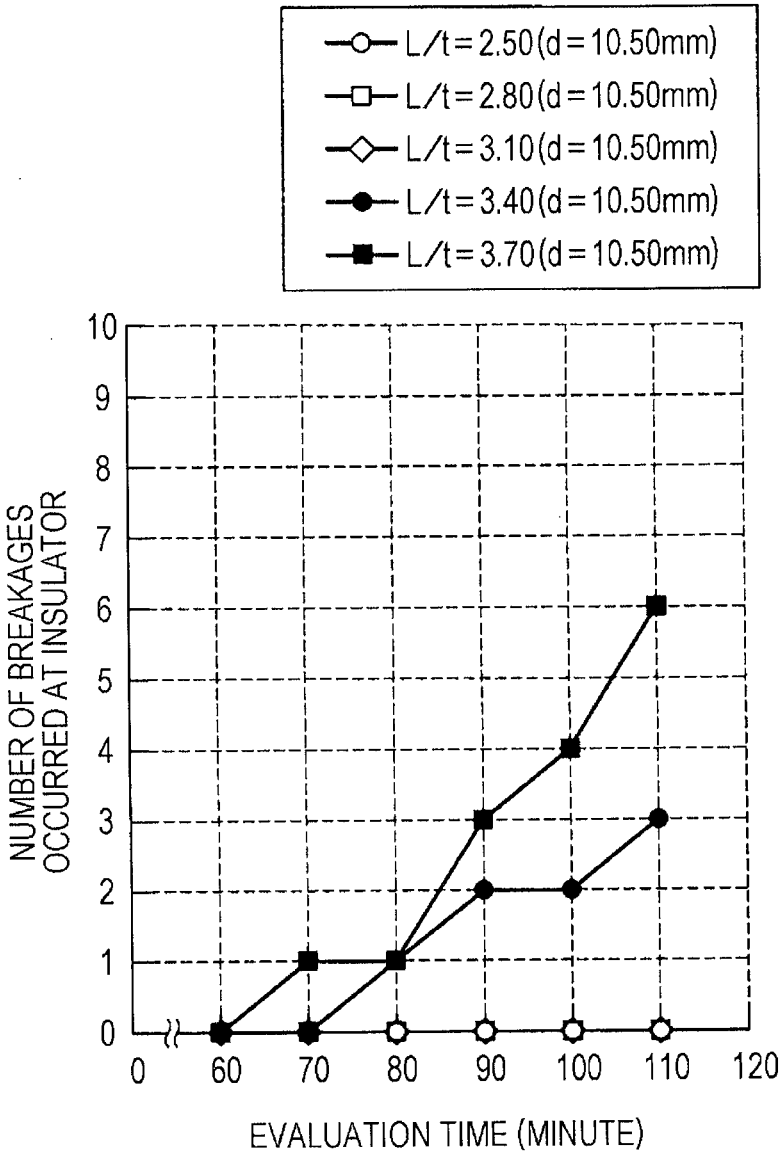
FIG. 8 is a graph of a result of a first evaluation test regarding the relationship between the length of the crimped lid and the thickness of the crimped lid.
Figure 9:
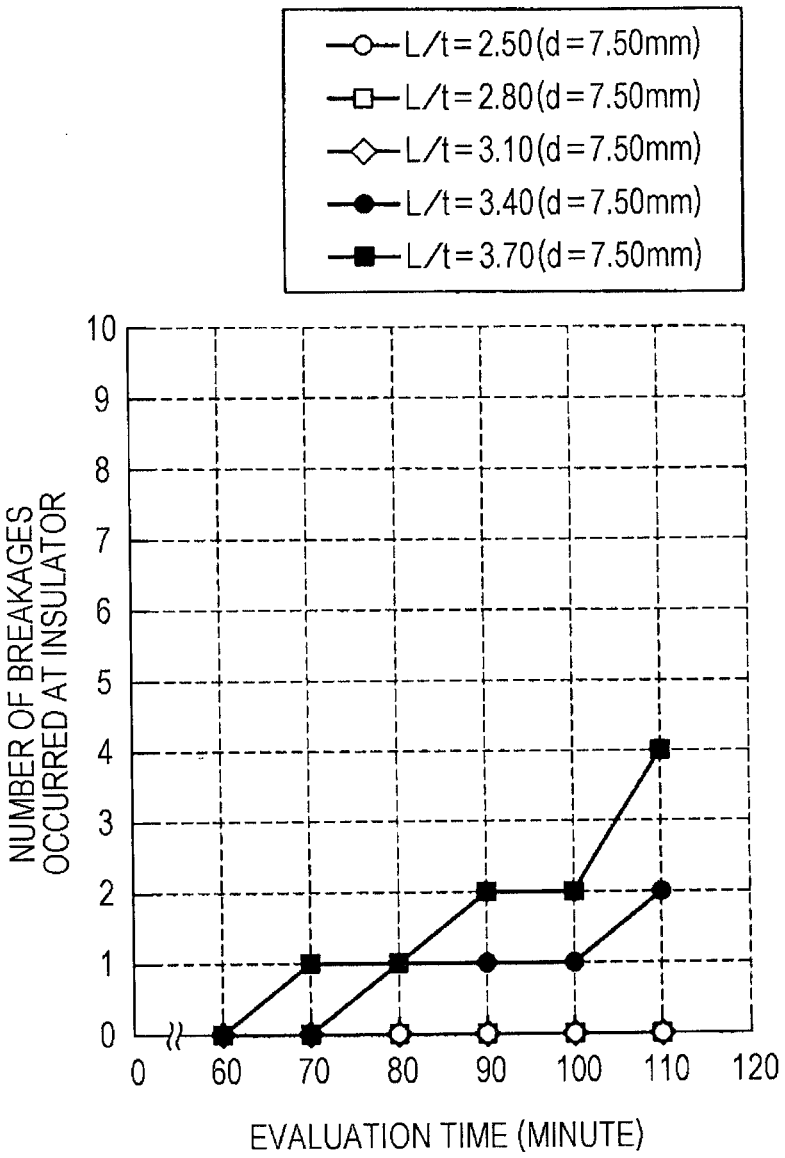
FIG. 9 is a graph of the result of the first evaluation test regarding the relationship between the length of the crimped lid and the thickness of the crimped lid.

A-2. First Evaluation Test:

FIGS. 8 and 9 are graphs where the results of the first evaluation test are illustrated. The first evaluation test relates to the relationship between the length L of the crimped lid 380 and the thickness t of the crimped lid 380. In the first evaluation test, the plurality of spark plugs 10 where the values (L/t) are mutually different were prepared as samples. An impact resistance test compliant to "HS B8031" was carried out on the samples. Specifically, the spark plug 10 (the sample) was installed to the impact resistance testing apparatus. With the state of normal temperature, impacts were applied to the samples 400 times per minute. Then, presence of damage to the insulators 200 in the samples was checked in every 10 minutes. In the first evaluation test, the samples with the same shape were each prepared by 10 pieces. The numbers of breakages occurred at the insulators 200 and their occurrence time were examined on each sample with the same shape. The graphs illustrated in FIGS. 8 and 9 indicate the evaluation time in the horizontal axis and the number of breakages occurred at the insulator 200 in the vertical axis.

The samples related to the evaluation results illustrated in FIG. 8 are the spark plugs 10 that include the threaded portion 320 with a nominal diameter of M12. In an evaluation related to FIG. 8, the minimum outer diameter d of the insulator 200 of the spark plug 10 was fixed at 10.50 mm while the value (D/d) was fixed at "1.15". The length L of the crimped lid 380 of the spark plug 10 was fixed at 2.05 mm. However, the external diameter of the crimped lid 380 (the thickness t in the intermediate portion of the crimped lid 380) was changed. According to this, the values (L/t) of the samples were set to "2.50", "2.80", "3.10", "3.40", and "3.70".

The samples related to the evaluation results illustrated in FIG. 9 are the spark plugs 10 that include the threaded portion 320 with a nominal diameter at the metal shell 300 of M12. In an evaluation related to FIG. 7, the minimum outer diameter d of the insulator 200 of the spark plug 10 was fixed at 7.50 mm while the value (D/d) was fixed at "1.15". The length L of the crimped lid 380 of the spark plug 10 was fixed at 2.05 mm. However, the external diameter of the crimped lid 380 (the thickness t in the intermediate portion of the crimped lid 380) was changed. According to this, the values (L/t) of the samples were set to "2.50", "2.80", "3.10", "3.40", and "3.70".

In the case where the value (L/t) was set to "2.30", when the spark plug 10 was assembled, breakage occurred at a portion where the insulator 200 contacts the ring member 610 in some cases. This is considered because that a pressing force by the crimped lid 380 to the ring member 610 against the insulator 200 is too strong.

Occurrence Rate of Breakage of the Insulator 200 at Assembly

- L/t=2.30, d=7.50 mm: breakage occurred in 5 pieces among 20 pieces
- L/t=2.50, d=7.50 mm: breakage did not occur in 20 pieces
- L/t=2.30, d=10.50 mm: breakage occurred in 3 pieces among 20 pieces
- L/t=2.50, d=10.50 mm: breakage did not occur in 20 pieces As illustrated in FIGS. 8 and 9, in the case where the value (L/t) was "2.50", "2.80", and "3.10", breakage did not occur in the insulator 200 in the impact resistance test for 110 minutes. Accordingly, it can be seen that the occurrence rate of breakage of the insulator 200 tends to be high as the value (L/t) becomes large like "3.40" . . . "3.70". The larger the value (L/t) becomes, the smaller the pressing force by the crimped lid 380 to the ring member 610 against the powder 650 becomes. In view of this, it is considered that the force for the powder 650 to hold the insulator 200 becomes small.

From comparison of FIGS. 8 and 9, it can be seen that the insulator 200 with small minimum outer diameter d has a lower occurrence rate of breakage of the insulator 200. This is considered because if the minimum outer diameter d is small, the mass of the insulator 200 becomes light. Therefore, an impact force applied to the insulator 200 is reduced.

According to the results of the first evaluation test, in view of reducing damage to the insulator 200 caused by deterioration over time of the crimped lid 380 due to an external force, the value (L/t) is preferably to be equal to or more than 2.50 and equal to or less than 3.40. The value (L/t) is more preferably to be equal to or more than 2.50 and equal to or less than 3.10.

Figure 4:
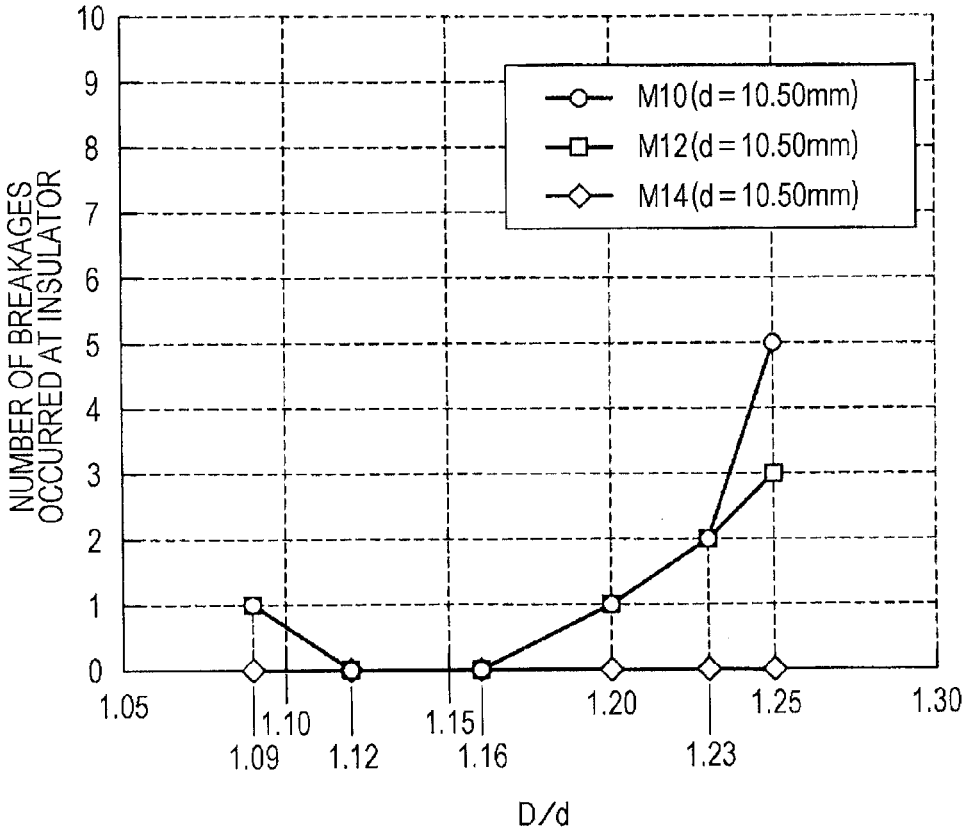
FIG. 4 is a graph of a result of a second evaluation test regarding a relationship between the minimum outer diameter of an insulator and the maximum inner diameter of a metal shell.
Figure 5:
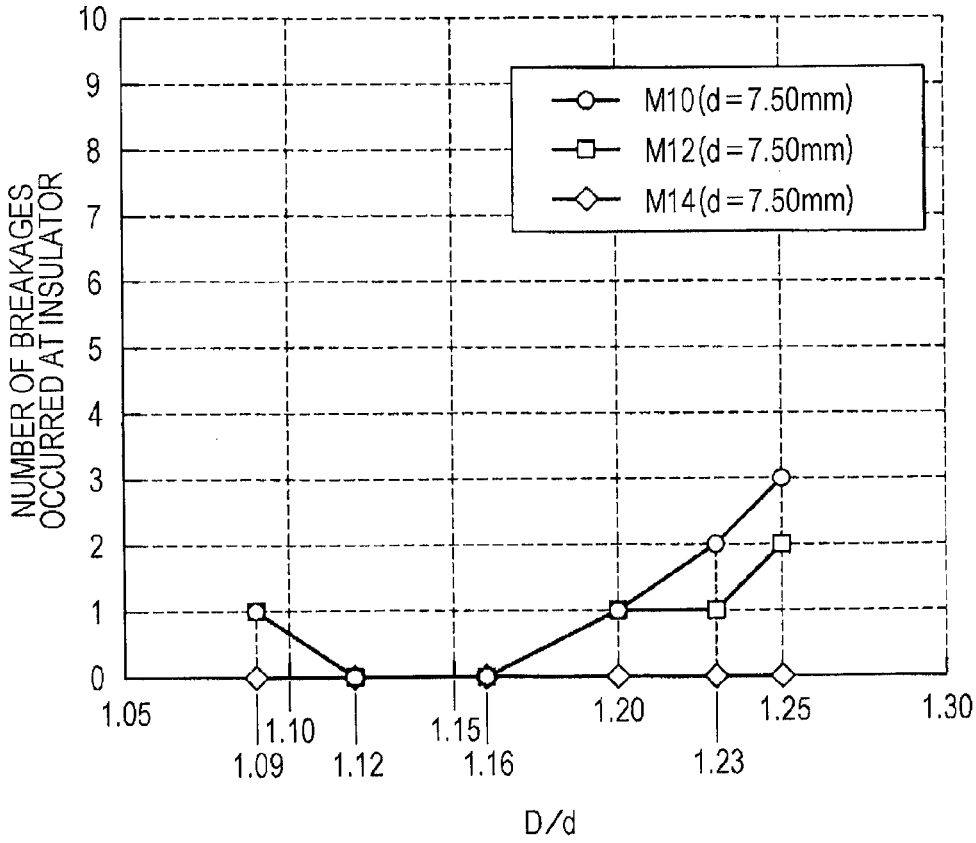
FIG. 5 is a graph of a result of the second evaluation test regarding the relationship between the minimum outer diameter of the insulator and the maximum inner diameter of the metal shell.

A-3. Second Evaluation Test:

FIGS. 4 and 5 are graphs of the results of the second evaluation test. The second evaluation test relates to the relationship between the minimum outer diameter d of the insulator 200 and the maximum inner diameter D of the metal shell 300. In the second evaluation test, the plurality of spark plugs 10 where the minimum outer diameter d of the insulator 200 and the maximum inner diameter D of the metal shell 300 are mutually different were prepared as samples. An impact resistance test compliant to JIS B8031 was carried out on the samples. Specifically, the spark plug 10 (the sample) was installed to an impact resistance testing apparatus. By heating the peripheral area of the gap SG in the spark plug 10 using a burner, the temperature of the center electrode 100 was maintained at 800° C. With this state, an impact was applied to the samples 400 times per minute for 10 minutes. Then, presence of breakage in the insulators 200 of the samples was checked. In the second evaluation test, the samples with the same shape were each prepared by 10 pieces. The numbers of breakages occurred at the insulators 200 were examined on every sample with the same shape. The graphs illustrated in FIGS. 4 and 5 indicate the value (D/d) in the horizontal axis and the number of breakages occurred at the insulator 200 in the vertical axis.

The samples related to the evaluation results illustrated in FIG. 4 are the spark plugs 10 that include the threaded portion 320 with a nominal diameter at the metal shell 300 of M10, M12, or M14. In an evaluation related to FIG. 4, the minimum outer diameter d of the insulator 200 of the spark plug 10 was fixed at 10.50 mm while the maximum inner diameter D of the metal shell 300 was changed. According to this, the values (D/d) of the samples were set to "1.09", "1.12", "1.16", "1.20", "1.23", and "1.25".

The samples related to the evaluation results illustrated in FIG. 5 are the spark plugs 10 that include the threaded portion 320 with a nominal diameter at the metal shell 300 of M10, M12, or M14. In an evaluation related to FIG. 5, the minimum outer diameter d of the insulator 200 of the spark plug 10 was fixed at 7.50 mm while the maximum inner diameter D of the metal shell 300 was changed. According to this, the values (D/d) of the samples were set to "1.09", "1.12", "1.16", "1.20", "1.23", and "1.25".

As illustrated in FIGS. 4 and 5, in the samples where the nominal diameter of the threaded portion 320 is M14, breakage did not occur in the insulator 200. Accordingly, it can be seen that an occurrence rate of breakage of the insulator 200 tends to be high as the nominal diameter of the threaded portion 320 becomes small like M12 . . . M10. In a construction of the spark plug, the smaller the nominal diameter of the threaded portion 320 becomes, the thinner the first tubular portion 210 and the second tubular portion 220 in the insulator 200 become. In view of this, it is considered that a strength of the insulator 200 is reduced, causing breakage of the insulator 200. The breakage of the insulator 200 occurred at the first tubular portion 210 of the insulator 200 with a comparatively small diameter.

Regardless of the size of the nominal diameter of the threaded portion 320, in the case where 1.12≤D/d≤1.16 is satisfied, it can be seen that breakage did not occur in the insulator 200. This is considered because of the reduction in difference in thermal expansion between the insulator 200 and the metal shell 300 suppresses a reduction of the force for the powder 650 to hold the insulator.

It can be seen that the occurrence rate of breakage of the insulator 200 tends to be high as the value (D/d) becomes larger than 1.16. That is, a coefficient of thermal expansion of the metal shell 300 is higher than that of the insulator 200. In view of this, the larger the maximum inner diameter D of the metal shell 300 with respect to the minimum outer diameter d of the insulator 200 becomes, the larger the difference in thermal expansion between the insulator 200 and the metal shell 300 in the filling-up area FA in a radial direction becomes. As a result, it is considered that the force for the powder 650 to hold the insulator 200 is reduced.

It can be seen that in the case where the value (D/d) is smaller than 1.12, breakage may occur in the insulator 200. In this case, a width between the insulator 200 and the metal shell 300 in the filling-up area FA in the radial direction (a clearance in the radial direction) becomes narrow. In view of this, ensuring a fill density of the powder 650 sufficiently is difficult. Consequently, it is considered that the force for the powder 650 to hold the insulator 200 becomes insufficient.

From comparison of FIGS. 4 and 5, it can be seen that the insulator 200 with small minimum outer diameter d has a lower occurrence rate of breakage of the insulator 200. This is considered because if the minimum outer diameter d is small, the mass of the insulator 200 becomes light; therefore, an impact force applied to the insulator 200 is reduced.

According to the results of the second evaluation test, in view of reducing damage to the insulator 200 caused by a difference in thermal expansion between the insulator 200 and the metal shell 300, the value (D/d) is preferably to be equal to or more than 1.12 and equal to or less than 1.23. The value (D/d) is more preferably to be equal to or less than 1.20 and further preferably to be equal to or less than 1.16.

Figure 6:
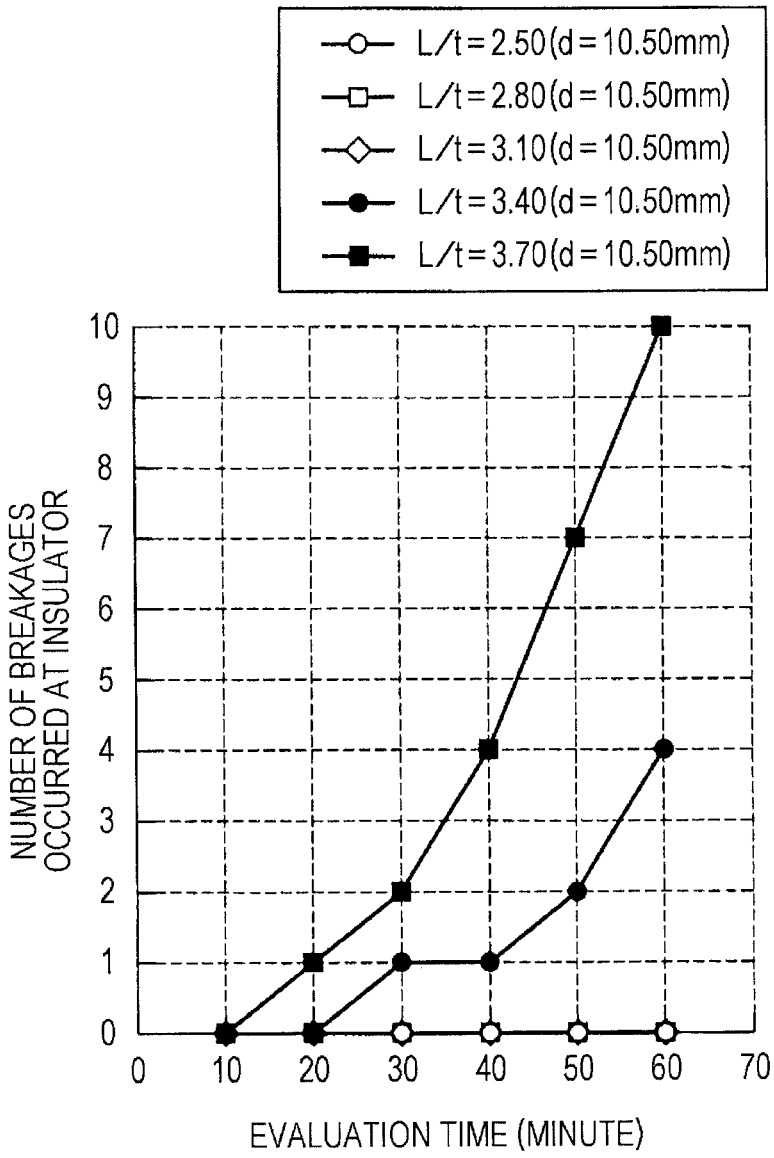
FIG. 6 is a graph of a result of a third evaluation test regarding a relationship between a length of the crimped lid and a thickness of the crimped lid.
Figure 7:
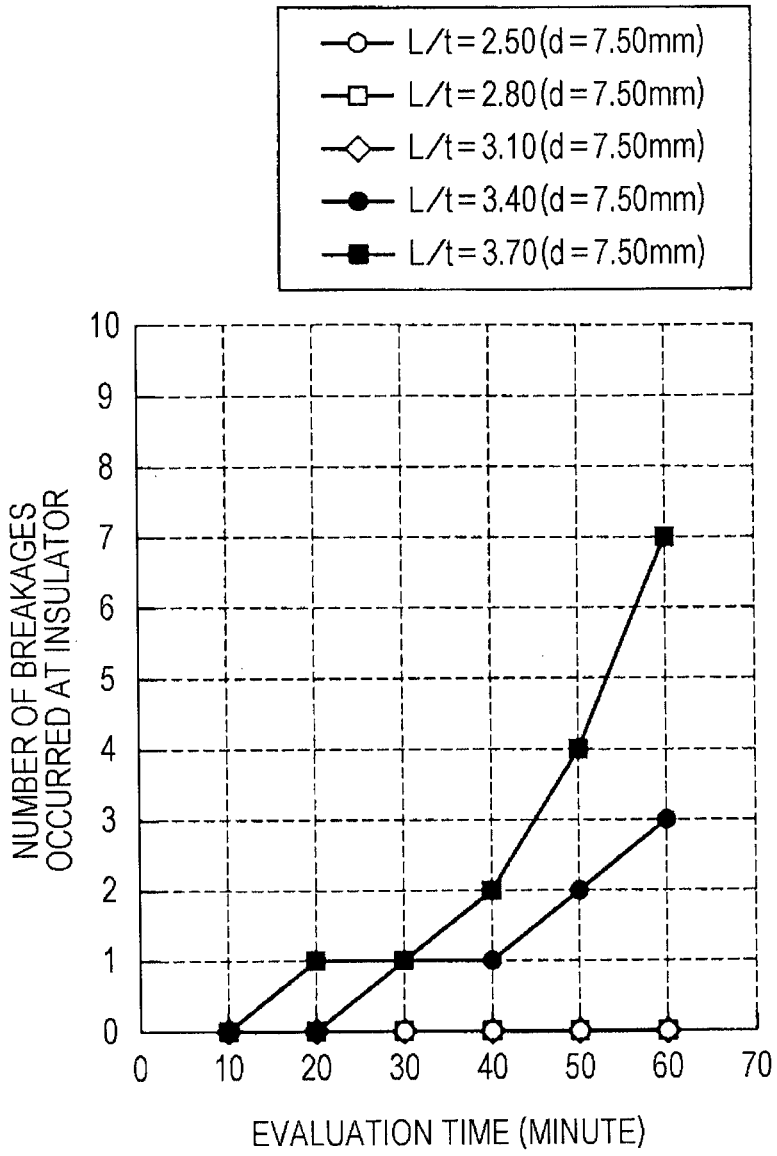
FIG. 7 is a graph of a result of the third evaluation test regarding the relationship between the length of the crimped lid and the thickness of the crimped lid.

A-4. Third Evaluation Test:

FIGS. 6 and 7 are graphs of the results of the third evaluation test. The third evaluation test relates to the relationship between the length L of the crimped lid 380 and the thickness t of the crimped lid 380. In the third evaluation test, the plurality of spark plugs 10 where the values (L/t) are mutually different were prepared as samples. An impact resistance test compliant to JIS B8031 was carried out on the samples. Specifically, the spark plug 10 (the sample) was installed to the impact resistance testing apparatus. By heating the peripheral area of the gap SG in the spark plug 10 using a burner, the temperature of the center electrode 100 was maintained at 800° C. With this state, an impact was applied to the samples 400 times per minute. Then, presence of damage to the insulators 200 was checked in every 10 minutes. In the third evaluation test, the samples with the same shape were each prepared by 10 pieces. The numbers of breakages occurred at the insulators 200 and their occurrence time were examined on each sample with the same shape. The graphs illustrated in FIGS. 6 and 7 indicate the evaluation time in the horizontal axis and the number of breakages occurred at the insulator 200 in the vertical axis.

The samples related to the evaluation results illustrated in FIG. 6 are the spark plugs 10 that include the threaded portion 320 with a nominal diameter at the metal shell 300 of M12. In an evaluation related to FIG. 4, the minimum outer diameter d of the insulator 200 of the spark plug 10 was fixed at 10.50 mm while the value (D/d) was fixed at "1.15". The length L of the crimped lid 380 of the spark plug 10 was fixed at 2.05 mm However, the external diameter of the crimped lid 380 (the thickness t in the intermediate portion of the crimped lid 380) was changed. According to this, the values (L/t) of the samples were set to "2.50", "2.80", "3.10", "3.40", and "3.70".

The samples related to the evaluation results illustrated in FIG. 7 are the spark plugs 10 that include the threaded portion 320 with a nominal diameter at the metal shell 300 of M12. In an evaluation related to FIG. 7, the minimum outer diameter d of the insulator 200 of the spark plug 10 was fixed at 7.50 mm while the value (D/d) was fixed at "1.15". The length L of the crimped lid 380 of the spark plug 10 was fixed at 2.05 mm. However, the external diameter of the crimped lid 380 (the thickness t in the intermediate portion of the crimped lid 380) was changed. According to this, the values (L/t) of the samples were set to "2.50", "2.80", "3.10", "3.40", and "3.70".

In the case where the value (L/t) was set to "2.30", when the spark plug 10 was assembled, breakage occurred at a portion where the insulator 200 contacts the ring member 610 in some cases. This is considered because that a pressing force by the crimped lid 380 to the ring member 610 against the insulator 200 is too strong.

Occurrence Rate of Breakage of the Insulator 200 at Assembly

L/t=2.30, d=7.50 mm: breakage occurred in 5 pieces among 20 pieces

L/t=2.50, d=7.50 mm: breakage did not occur in 20 pieces

L/t=2.30, d=10.50 mm: breakage occurred in 3 pieces among 20 pieces

L/t=2.50, d=10.50 mm: breakage did not occur in 20 pieces

As illustrated in FIGS. 6 and 7, in the case where the value (L/t) was "2.50", "2.80", and "3.10", breakage did not occur in the insulator 200 in the impact resistance test for 60 minutes. Accordingly, it can be seen that the occurrence rate of breakage of the insulator 200 tends to be high as the value (L/t) becomes large like "3.40" . . . "3.70". The larger the value (L/t) becomes, the smaller the pressing force by the crimped lid 380 to the ring member 610 against the powder 650 becomes. In view of this, it is considered that the force for the powder 650 to hold the insulator 200 becomes small.

From comparison of FIGS. 6 and 7, it can be seen that the insulator 200 with small minimum outer diameter d has a lower occurrence rate of breakage of the insulator 200. This is considered because if the minimum outer diameter d is small, the mass of the insulator 200 becomes light; therefore, an impact force applied to the insulator 200 is reduced.

According to the results of the third evaluation test, in view of reducing damage to the insulator 200 caused by the difference in thermal expansion between the insulator 200 and the metal shell 300, the value (L/t) is preferably to be equal to or more than 2.50 and equal to or less than 3.40. The value (L/t) is more preferably to be equal to or more than 2.50 and equal to or less than 3.10.

A-5. Effect:

As described above, according to the embodiment, in the case where 2.50≤L/t≤3.10 is satisfied, the pressing force by the crimped lid 380 to the ring member 610 against the powder 650 can be improved. Accordingly, the force for the powder 650 to hold the insulator 200 can be improved. Consequently, damage to the insulator 200 caused by the deterioration over time due to an external force can be further reduced.

In the case where 1.12≤D/d—1.16 is satisfied, the difference in thermal expansion between the insulator 200 and the metal shell 300 can be reduced. Accordingly, reduction in the force for the powder 650 to hold the insulator 200 can be further reduced.

B. Another Embodiment:

This disclosure is not limited to the above-described embodiments, working examples, and modifications. This disclosure may be practiced in various forms without departing from its spirit and scope. For example, to solve a part of or all of the above-described problems, or to achieve a part of or all of the above-described effects, "the embodiments corresponding to the technical feature in each embodiment and the technical feature in the embodiments and the modifications disclosed in this description" may be, as necessary, replaced or combined. If the technical feature is not described as essential in the description, it can be deleted as necessary.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A spark plug comprising:

a tubular insulator extending along and centered on an axis; and a tubular metal shell secured to an outer peripheral surface of the insulator by crimping, the tubular metal shell including an inner peripheral surface and being filled up with powder for sealing between the outer peripheral surface of the insulator and the inner peripheral surface, wherein the metal shell includes a tool engagement portion and a crimped lid, the tool engagement portion overhanging in a polygonal shape in an outer circumferential direction, the crimped lid is disposed at an end portion of the metal shell coupled to the tool engagement portion, the end portion being bent toward the outer peripheral surface of the insulator by crimping, the powder is filled between the crimped lid and the insulator, an annular ring member that contacts the inner peripheral surface of the crimped lid of the metal shell and the outer peripheral surface of the insulator, and a relationship between a length L and a thickness t satisfies 2.50≤L/t≤3.10, the length L being a length along a shape of the crimped lid from the tool engagement portion to the insulator in a planar surface that passes through the axis, the thickness t being a thickness at a midpoint provided on the shape of the crimped lid.

2. The spark plug according to claim 1, wherein a relationship between a minimum outer diameter d of the insulator and a maximum inner diameter D of the metal shell in a filling-up area where the powder is filled between the metal shell and the insulator satisfies 1.12≤D/d≤1.16.

3. The spark plug according to claim 1, wherein the metal shell includes a threaded portion with a nominal diameter of equal to or less than M12.

4. The spark plug according to claim 2, wherein the metal shell includes a threaded portion with a nominal diameter of equal to or less than M12.

5. the spark plug according to claim 1, wherein the relationship between the length L and the thickest t satisfies 2.50≤L/t≤2.80.

* * * * *